United States Patent [19]

Timmons

[11] 4,035,972

[45] July 19, 1977

[54] PANEL JOINING ARRANGEMENTS

[76] Inventor: Jay Timmons, 921 Via Panarama Ave., Palos Verdes Estates, Calif. 90274

[21] Appl. No.: 660,366

[22] Filed: Feb. 23, 1976

[51] Int. Cl.[2] ..... E04G 3/08; E04B 2/78

[52] U.S. Cl. ..... 52/241; 52/36; 52/281; 52/586

[58] Field of Search ..... 52/241, 281, 282, 239, 52/238, 242, 36; 211/193; 248/243

[56] References Cited

U.S. PATENT DOCUMENTS

| | | | |
|---|---|---|---|
| 2,915,151 | 12/1959 | Kekenak | 52/239 |
| 2,956,766 | 10/1960 | Galassi | 248/243 |
| 3,261,625 | 7/1966 | Cripe | 52/239 |
| 3,358,956 | 12/1967 | Thornton | 248/243 |
| 3,691,709 | 9/1972 | Ostborg | 52/239 |
| 3,755,979 | 9/1973 | Pantazi | 52/241 |
| 3,834,092 | 9/1974 | Whisson | 52/282 |

FOREIGN PATENT DOCUMENTS

| | | | |
|---|---|---|---|
| 751,254 | 1/1967 | Canada | 248/243 |

*Primary Examiner*—John E. Murtagh
*Attorney, Agent, or Firm*—Fraser and Bogucki

[57] ABSTRACT

Thin, planar panels are joined at their edges by an arrangement which includes a hollow, slotted spacing member which seats within grooves in the opposite facing portions of the panel edges to separate the panel edges by a selected distance. Each panel is provided with a bottom connecting member mounted on the bottom of the panel and extending outwardly and upwardly and into the open bottom end of the spacing member. A top connecting member has opposite ends thereof secured to the tops of the panels so as to extend between the panels and over the top of the spacing member. Corners are formed by permanently attaching a pair of spacing members to the right angle edges of a corner post and then positioning the open bottom ends of the spacing members over the up turned ends of bottom connecting members extending from facing portions of a pair of panels to be joined to the corner post. The right angle intermediate portion of a top connecting member is secured within the top of the corner post and the opposite ends thereof are fastened to the tops of the joining panels. The panels are provided with removable top caps held in place on top of the panel by securing the flared end portions of fasteners mounted within the top cap within the inclined slots in fastening brackets secured to the top of the panel. Mounting brackets for supporting shelves and the like at the sides of the panels extend through the thin space between adjacent panels and are secured within the slotted spacing members by a pair of hook members engaging the slots to hold the mounting bracket snugly against the spacing member and a lower projection which wedges against the upper end of a lower slot to prevent inadvertent upward movement or release of the mounting bracket from the spacing member.

8 Claims, 10 Drawing Figures

Fig. 1
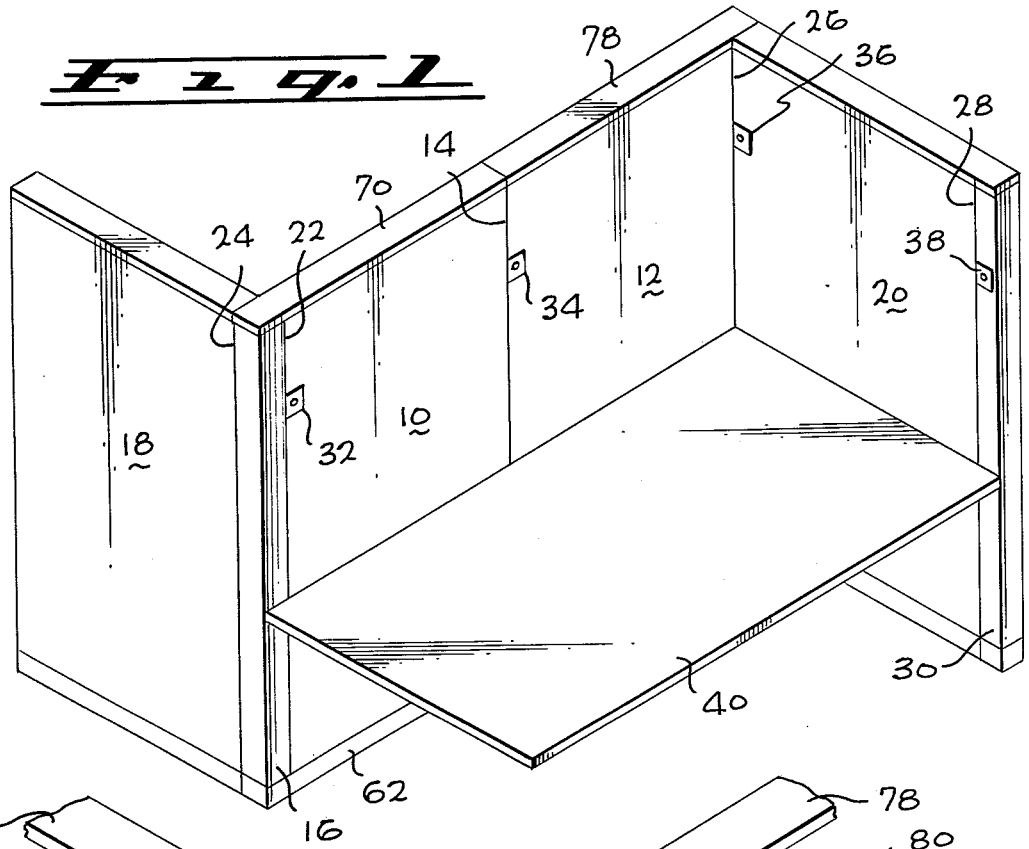
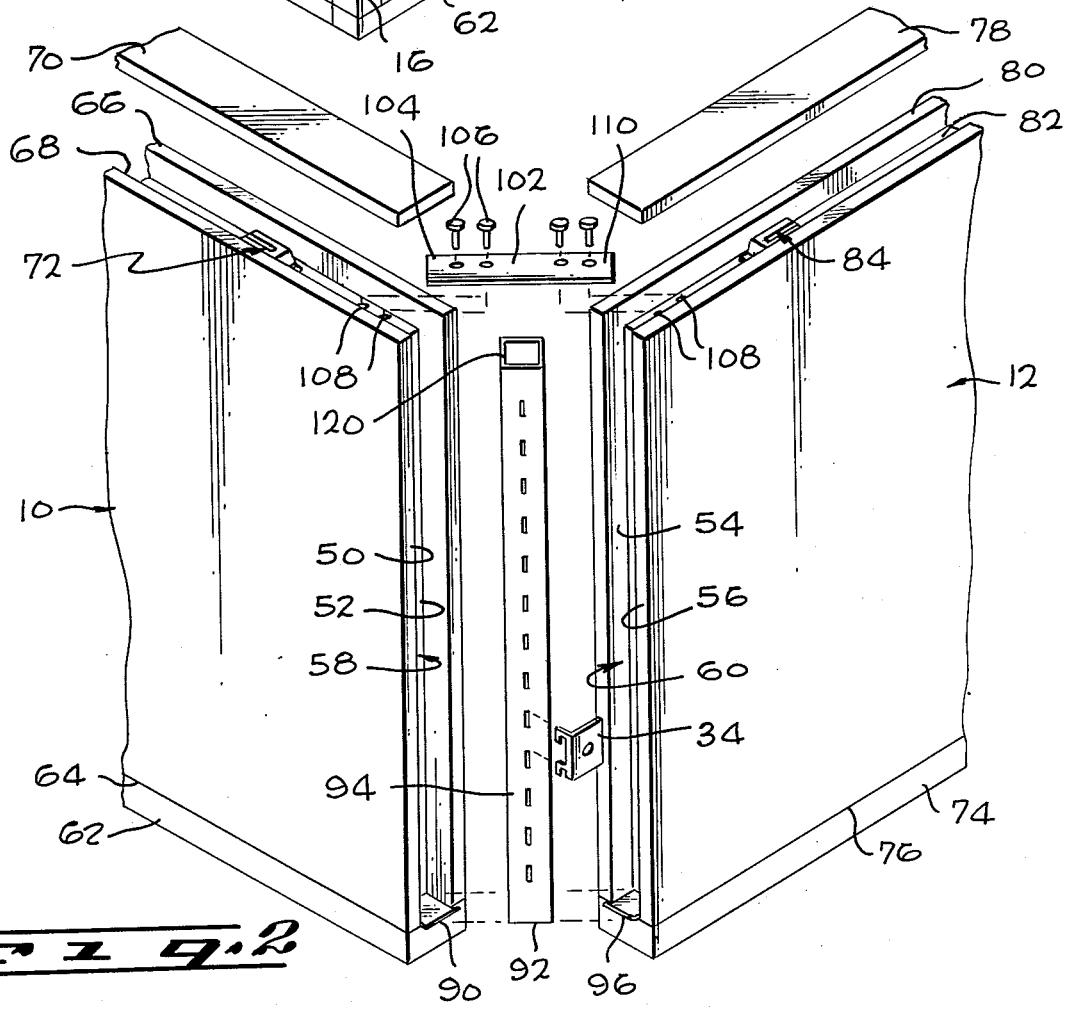
Fig. 2

Fig. 3
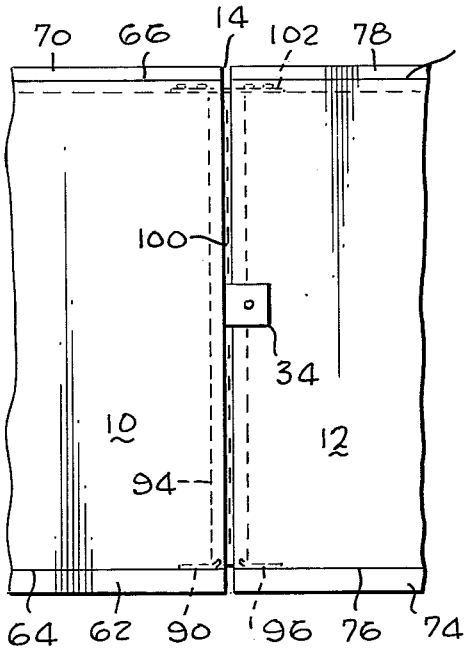
Fig. 8
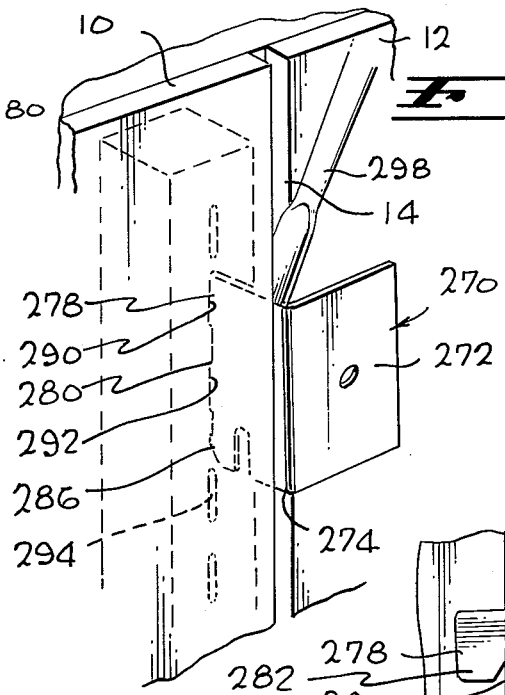
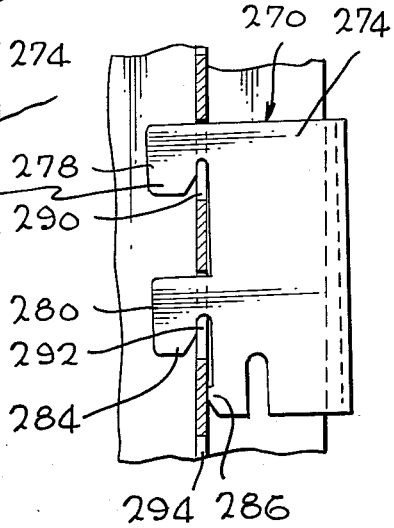
Fig. 9
Fig. 6
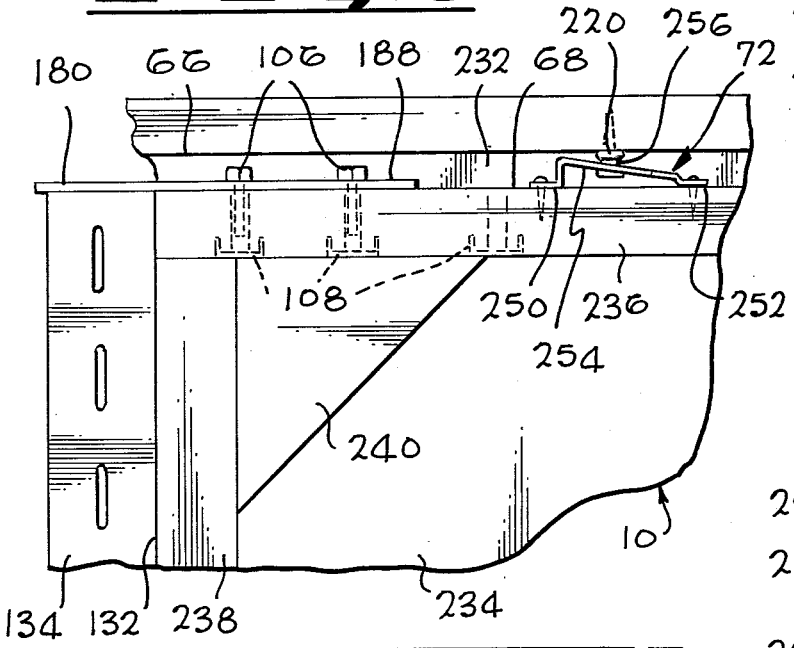
Fig. 7
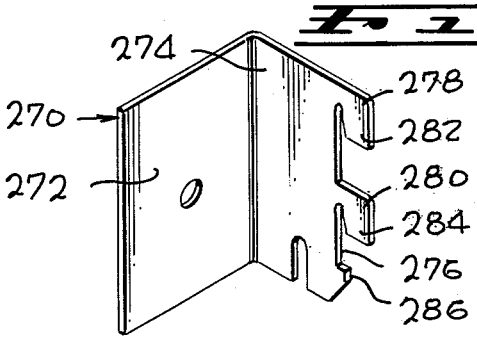
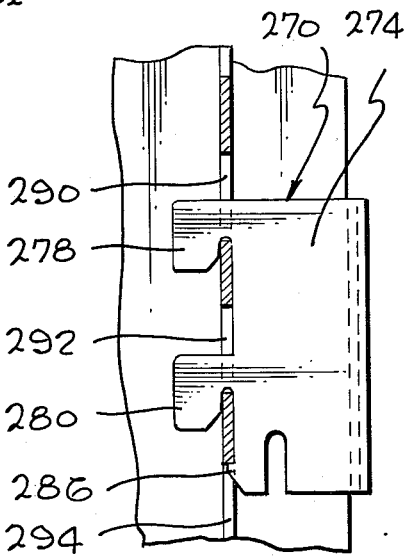
Fig. 10

PANEL JOINING ARRANGEMENTS

BACKGROUND OF THE INVENTION

1. History of the Invention

The present invention relates to arrangement for fastening together panels to form furniture arrangement including desks, work areas, partitions and the like, and to such arrangements in which mounting brackets may be fastened to one or more of the panels to acts as supports for still other panels or shelves in the furniture arrangement.

2. History of the Prior Art

A modern trend in the furnishing of offices is to replace conventional pieces of furniture such as individual desks, credenzas and the like with arrangements assembled from a plurality of panels. Such arrangements provide versatility of the type not always achievable with more conventional office furniture in that a particular working area may be custom designed to meet particular needs. For example, in a given situation where a desk or other working top is required together with a certain amount of storage shelf space within a limited amount of space, the use of panel arrangements permits the furniture dictated by such requirements to be custom designed simply by joining the panels together in a desired arrangement which may be limited only by the size of the panels, the number of panels available, and the locations and types of joints which can be made. Such panel arrangement have the further advantage of providing a large, flat area which not only serves as a back member or panel for the working and storage surfaces provided thereby but which also may serve as a wall or partition member.

Panels arrangements have become particularly useful in certain types of modern offices where space may be at a premium due to its cost, where the cost of construction walls to form individual offices may be prohibitive, or where it is desired to provide partitions of various heights, sizes and designs for aesthetic reasons. Moreover with a higher frequency of offices being rearranged, reorganized or moved to other locations or buildings, it is highly desirable to be able to quickly and cheaply assemble furniture and partitions to suit particular needs, and thereafter to be able to easily disassemble such arrangements and move them elsewhere where they may be assembled in the same or different form.

Presently known panel arrangements of the type used to construct office furniture, office partitions and similar structures suffer from deficiencies which limit the usefulness of such arrangements. One problem found in such arrangements is the difficulty often encountered in joining the individual panels to one another and, once joined, in thereafter easily separating the panels for rearrangement or relocation.

One type of panel joining arrangement shown in U.S. Pat. No. 3,806,102, Albinson et al., makes use of flange elements secured to the tops and bottoms of adjoining panels. The top flange elements are of relatively complex construction so as to engage and secure the top portions of mounting brackets which are themselves limited to fixed heights and locations at the panel joints. The bottom flange elements require that panels to be joined by turned upside down or in any event placed so as to afford access to the panel bottoms, a technique which has proven to be cumbersome considering the relatively substantial weight of many such panels and particularly in arrangements where a number of the panels are to be assembled into a particular complex. A somewhat similar arrangement which minimizes some of the problems of this type of joining arrangement is shown in U.S. Pat. No. 3,713,257, Beavers. The Beavers arrangement which employs top and bottom junction plates having slots which are engaged by locking elements are themseleves seated within specially configurated grooves in the panel tops and bottoms, thereby providing some convenience and efficiency in the joinder of the panels at the expense of a joinder arrangement which is relatively complex in other respects and particularly requires panels of custom design and construction.

The joining arrangement shown in the Beavers patent is typical of many prior art joining arrangements which provide for a relatively strong and substantial joint which in many cases is relatively easily provided and without the need for an elaborate array of specialized tools, but almost always at the expense of requiring parts of relatively complex and custom design which are often difficult and quite expensive to manufacture and which limit the technique to the use of panels properly equipped with an elaborate arrangement of special parts of fasteners so as to make them usable in the joining arrangement. Such arrangements are shown, for example, by U.S. Pat. No. RE27,215, Propst, et al., where a central channel has openings for receivng elements fixed and protruding from the edges of the panels, a top member adjusting the height of the central channel relative to the panels to vary the wedging action of the elements within the channel openings, by U.S. Pat. No 3,694,975, Pollock, where a slotted spline which receives mounting brackets is provided with slots to receives fingers extending from one or both panels as well as fingers for engagement in slots in the panel ends, by U.S. Pat. No. 1,208,568, Kane, where panels are joined through a common member by apertured protrusions from one end which extend through the common member and the other end and receive pegs therein, by U.S. Pat. No. 3,492,766, Andrew, where an apertured spline adapted to have brackets mounted thereon is engaged by tabs extending from special structures at the panel ends so as to engage and properly vertically position the panels relative to the spline, by U.S. Pat. No. 3,471,978, Fenwick, U.S. Pat. No. 3,648,419, Marks, and U.S. Pat. No. 2,796,158, Miles, et al., each of which shows a joining arrangement employing a common member of unique and complex design.

In contrast U.S. Pat. No. 3,174,592, Berman, et al., shows a joining arrangement employing a slotted central member which is of simple, standard design and which is capable of mounting brackets for supporting shelves and the like. However, the joining arrangements in Berman et al. are used with very thin panels in the nature of sheets of uniform, single ply construction, and at that require special brackets mounted on the edges of the sheets for engagement with the common members.

Further problems of the prior art reside in the absence of finishing members such as top caps on the panels to provide the panels with a neat and finished appearance by serving in part to conceal some of the elements used to join the panels together. Still other arrangements employ such finishing members but fail to attach them to the panels in an easy and convenient way which facilitates ready removal of such members for disassembly or rearrangement of the panels.

Many of the panel joining arrangements shown in the previously referred to prior art patents as well as other prior art patents make use of a slotted central or other member for mounting brackets of the type useful in supporting shelves and the like. The brackets themselves typically include a plurality of finger-like projections for engagement in the slots. Further examples of mounting brackets of this type are provided by U.S. Pat. Nos. 3,358,956; 256,672; 1,983,470; 2,681,786; 2,956,766; 3,322,288; 3,353,684; 3,511,193; 3,570,798; 3,713,257 and 3,730,477.

Many of the prior art mounting bracket arrangements have various shortcomings, particularly in terms of being able to mount the bracket so that it is secure and resistant to inadvertent loosening and removal while at the same time being easily removed or installed when it is desired to do so. The above-identified patent to Thornton, U.S. Pat. No. 3,358,956, is typical of those patents which attempt to impart some stability to the mounting bracket by providing it with a projecting tab or other protruding element in combination with one or more finger or hook elements. In this type of arrangement the projecting tab typically is received in one of the slots so as to reside against the bottom edge thereof to provide vertical and some lateral support and stability for the bracket. Such arrangements do not, however, act to prevent inadvertent upward movement or release of the bracket. Still other arrangements which provide some resistance to unwanted upward movement or release of the bracket are illustrated by the above referred to Knape U.S. Pat. No. 1,983,470. In the Knape patent each mounting bracket is provided with a pair of hook members and a pair of projections. The projections which are considerably smaller than the hook members reside within and completely occupy slots of special size and spacing from the main slots accommodating the hook members, thereby requiring use of a slotted member having slots of nonuniform size and spacing. Moreover, the particular design in Knape is such that the hook members once installed in their slots do not cooperate with the projections in providing a close, snug fit of the type which discourages unwanted looseness or inadvertent release of the mounting bracket.

Accordingly, it would be desirable to provide a panel joining arrangement of relatively simple design which makes use of standard, commercially available parts for use as the common spacing member as well as other portion of the joinder arrangement and which greatly facilitates the joinder of panels in the place and position where they are to be used without the need for turning the panels upside down or otherwise arrangement them merely for purposes of effecting joinder of the panels. It would furthermore be advantageous to provide a panel joining arrangement permitting and providing for the use of finishing members such as top caps which are easily installed on as well as removed from the panels while at the same time providing a finished appearance and comprising a permanent looking part of the panels when installed. It would still furthermore be desirable to provide a panel joining arrangement in which mounting brackets can be mounted on a standard member having slots of uniform size and spacing so as to lock the mounting brackets in place against unwanted looseness or removal while at the same time permitting relatively easy loosening and removal of the mounting brackets when it is desired to do so.

BRIEF SUMMARY OF THE INVENTION

Panel joining arrangements in accordance with the invention utilize a common spacing member of standard commercial design which resides within grooves in the edges of the panels to hold the panels spaced apart by a desired distance. The spacing member which has an aperture in the bottom end thereof locks the adjoining panels in position against the opposite sides thereof via bottom connecting members fastened to the bottom edges of the panels and which extend outwardly from the opposite facing portions of the panels while curving upwardly and extending into and being received within the aperture at the bottom end of the spacing member. Joinder of the panels is completed by securing the opposite ends of a top joining member to the tops of the panels, the top joining member extending between the panels and over the top end of the spacing member. The top connecting member is concealed by the installation of top caps which provide the panels with a finished appearance. The top caps are releasably secured to the tops of the panels by flared fastening elements secured to the underside of the top caps and which are received within the slots of the inclined intermediate portions of fastening brackets having the opposite ends thereof secured to the tops of the panels. The top caps are easily installed on the tops of the panels by driving them in a lateral direction so as to wedge the flared fastening elements into locked positions within the slots in the fastening brackets. Thereafter striking the top caps in the opposite direction serves to loosen the flared fastening elements within the slots to permit easy removal of the top caps from the panel tops.

Corner joining arrangements in accordance with the invention include the use of a corner post having slots in right angle surfaces thereof into which are permanently secured such as by screws a pair of the slotted spacing members. Each of the two different panels to be joined at the corner is then joined to the corner post by insertion of the bottom connecting member into the open bottom end of a different one of the spacing members, following which a top connecting member having a right angled bend at the middle thereof has the opposite ends thereof secured to the tops of the two different panels. The intermediate portion of the top connecting member having the right angle bend is secured within the top of the corner post as to draw the top portions of the panels toward and into contact with the corner post.

The relatively narrow space between panels provided by the spacing member enable mounting brackets to extend through such spaces from the outsides of the panels for mounting on the spacing members. A plurality of hook elements extending outwardly from a relatively straight edge of the mounting bracket are received within a plurality of the slots of uniform size and spacing within the spacing member such that the downwardly extending finger-like projections at the outer extremities thereof fit snugly against the inside surface of the spacing member. A small projection extending from the relatively straight edge of the mounting bracket below the hook elements and which is of considerably smaller size and of length not substantially greater than the depth of the slots engages against the upper edge of one of the slots to lock the mounting bracket into place and resist play and unwanted upward movement or release by driving the mounting bracket downwardly after seating of the hook elements within the slots. The mounting bracket may be loosened and removed by striking it in an upward direction to unseat the projection from the upper edge of one of the slots and permit upward movement of the mounting bracket until the finger-like projections of the hook elements clear the edges of the slots.

BRIEF DESCRIPTION OF THE DRAWINGS

The foregoing and other objects, features and advantages of the invention will be apparent from the following more particular description of preferred embodiments of the invention, as illustrated in the accompanying drawings in which:

FIG. 1 is a perspective view of a panel arrangement in accordance with the invention;

FIG. 2 is an exploded view of a linear joining arrangement of two of the panels in the arrangement of FIG. 1;

FIG. 3 is a frontal view of the joining arrangement of FIG. 2 upon joinder of the panels;

FIG. 6 is a broken away view of the corner of one of the panels showing the manner in which the top caps are releasably fastened to the panels;

FIG. 7 is a perspective view of a mounting bracket in accordance with the invention;

FIG. 8 is a perspective view of the joining arrangement of two panels showing the manner in which the mounting bracket of FIG. 7 is mounted on the spacing member of the joining arrangement;

FIG. 9 is a sectional view of the arrangement of FIG. 8 showing the mounting bracket before it is locked in place; and FIG. 10 is a sectional view of the arrangement of FIG. 8 showing the mounting bracket after it is locked in place.

DETAILED DESCRIPTION

Figure 4:
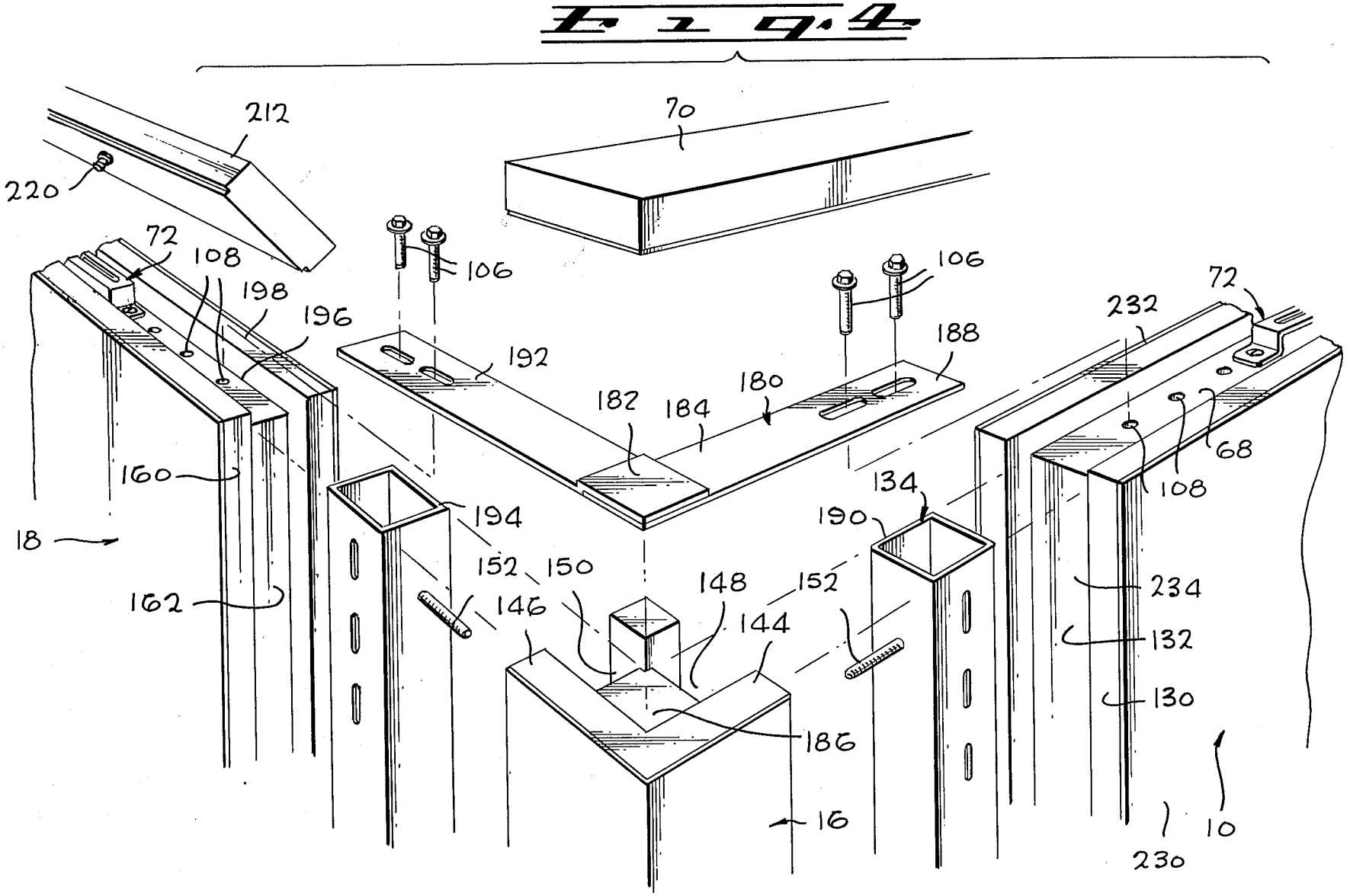
FIG. 4 is an exploded view of the upper portion of a corner joining arrangement for panels in the arrangement of FIG. 1.

FIG. 1 depicts an arrangement of panels and related components illustrating the manner in which the panels can be joined in accordance with the invention to provide partitions, office furniture and the like. In the FIG. 1 arrangement two different panels 10 and 12 of like construction are coupled together at a linear joinder arrangement 14. The opposite end of the panel 10 is joined through a corner post 16 to another panel 18 so as to form a right angle with the panel 18. Similarly, the opposite end of the panel 12 is coupled through a corner post, (not shown) to a panel 20 forming a right angle therewith. The corner post 16 forms a joint 22 with the panel 10 and a joint 24 with the panel 18. The panel 20 forms a joint 26 with the corner post (not shown) at the end of the panel 12. The opposite end of the panel 20 forms a joint 28 with a center post 30.

In accordance with the invention the various panels 10, 12, 18 and 20 which are generally identical in construction are universal in the sense that they can be joined to one another to form a variety of different configurations. Right angle bends are formed with the aid of a center post such as the post 16. Also, exposed edges of a panel are finished in a center post such as the post 30. Each joint between the panels or between a panel and a center post is capable of mounting one or more mounting brackets at selected heights along the length of the joint. In the arrangement of FIG. 1 four different mounting brackets 32, 34, 36 and 38 are mounted at the joints 22, 14, 26 and 28 respectively. The mounting brackets 32, 34, 36 and 38 are approximately at the same height and are capable of supporting a common member similar to a flat, planar shelf 40 mounted therebelow. However, the mounting brackets can be mounted at different heights and in different combinations within the various joints to provide almost endless combinations within the various joints to provide an almost endless variety of different possibilities for connecting structure to the various panels.

FIG. 2 and 3 illustrate a linear joining arrangement in accordance with the invention. In this particular instance the illustrated arrangement comprises the panels 10 and 12 and the joint 14 therebetween. The panel 10 which is of generally thin, planar configuration has a side edge 50 thereof provided with a longitudinal groove 52 extending along the length of the edge 50. In like fashion the panel 12 has a longitudinal groove 54 extending along the length of a side edge 56 thereof. The side edges 50 and 56 with their included grooves 52 and 54 form opposite facing portions 58 and 60 of the joining arrangement.

The panel 10 has a base 62 mounted on a bottom edge 64 thereof. A top edge 66 of the panel 10 has a groove 68 extending along the length thereof and is covered by a finishing element in the form of a top cap 70 which is generally co-extensive with the top edge 66 when mounted thereon. As described hereafter the top caps are easily and quickly installed and removed through use of fastening arrangements in which tapered fasteners attached to the underside of the top caps are wedged into position within inclined slots in fastening brackets mounted on the bottom surface of the grooves within the top edges of the panel. One such fastening bracket 72 is shown in FIG. 2 at the top of the panel 10. In like fashion the panel 12 has a base 74 mounted at a bottom edge 76 thereof and a top cap 78 mounted on a top edge 80 thereof. The top edge 80 has a groove 82 running along the length thereof. A fastening bracket 84 is shown mounted on the bottom surface of the groove 82.

A bottom connecting member 90 which is mounted on the bottom edge 64 of the panel 10 extends outwardly from the facing portion 50 within the groove 52. The outwardly extending portion of the bottom connecting member 90 curves upwardly and extends into an aperture at the bottom end 92 of a slotted spacing member 94. Similarly the panel 12 is equipped with a bottom connecting member 96 mounted on the bottom edge 76 thereof and extending outwardly and curving upwardly within the groove 54 at the bottom of the facing portion 56. The bottom connecting member 96 also extends into the aperture at the bottom end 92 of the spacing member 94. The spacing member 94 resides within the grooves 52 and 54 in the opposite facing portions 50 and 56 so as to hold the panels 10 and 12 spaced apart from each other by a selected distance. This distance shown by the space 100 in FIG. 3 provides access to the various slots along the length of the spacing member 94 to provide access to the slots along the length of the spacing member 94 to facilitate mounting of the mounting brackets such as the bracket 34.

With the bottom connecting members 90 and 96 disposed within the aperture at the bottom end 92 of the spacing member 94 the lower portions of the opposite facing portions 50 and 56 of the panels 10 and 12 are held in engagement with the opposite sides of the lower portion of the spacing member 94. The upper portions of the facing portions 50 and 56 are held against the opposite sides of the spacing member 94 by a top mounting member 102 of thin, flat, elongated configuration. One end 104 of the top connecting member 102 is fastened to the bottom surface of the groove 68 within the top edge 66 of the panel 10 via a pair of bolts 106 which extend through holes in the top connecting member 102 and are secured within T-nuts 108 disposed within the top edge 66 of the panel 10 so as to terminate at the bottom surface of the groove 68. The opposite end 110 of the top connecting member 102 is secured to the bottom surface of the groove 82 within the top edge 80 by a pair of bolts 106 extending through holes in the end 110 and into T-nuts 108 mounted within the top edge 80 of the panel 12. The top connecting member 102 extends over the top end 120 of the spacing member 94 to prevent upward movement of the member 94 and thereby maintain the bottom connecting members 90 and 96 secured within the aperture at the bottom end 92 of the spacing member 94.

Figure 5:
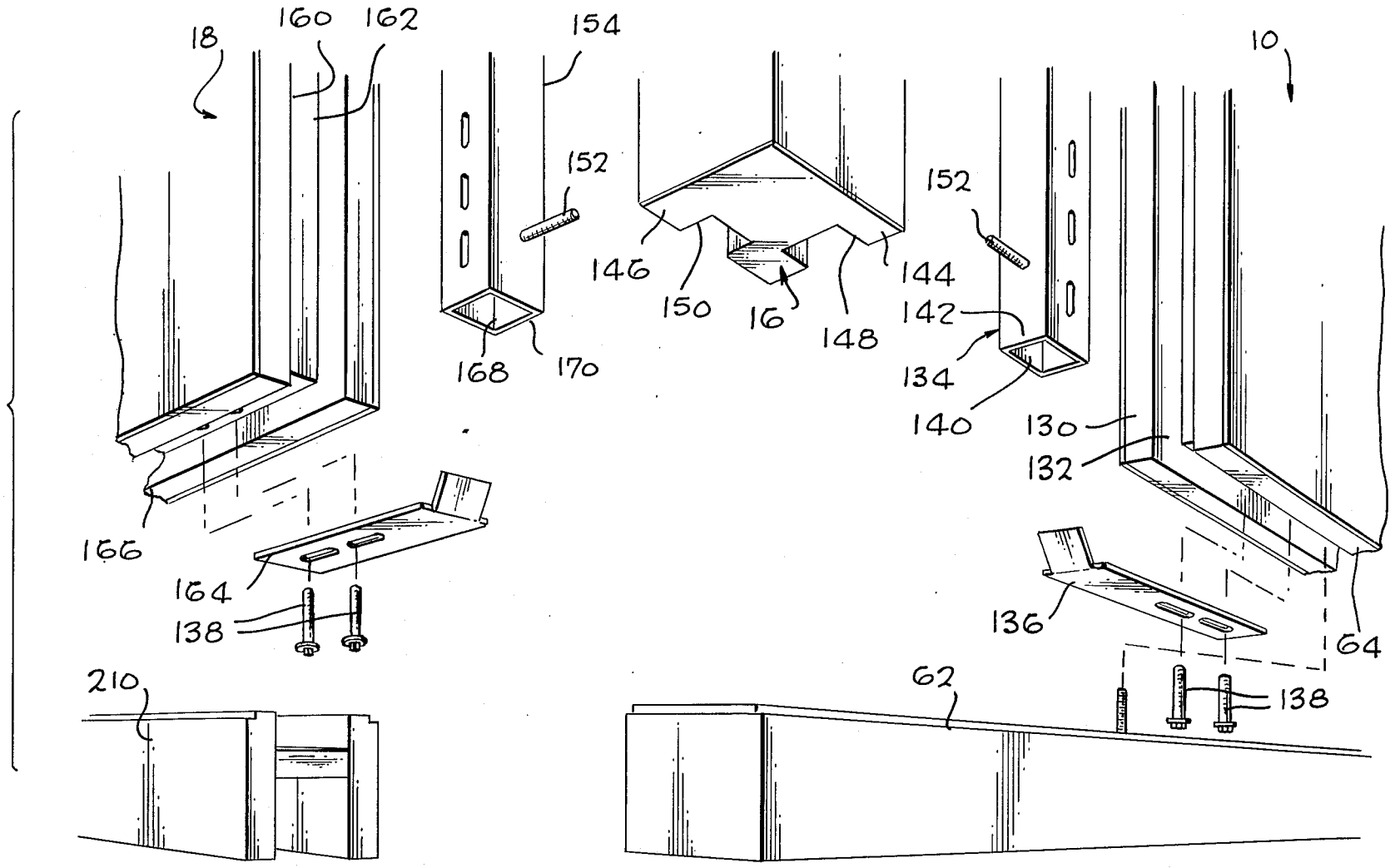
FIG. 5 is an exploded view of the lower portion of the joining arrangement of FIG. 4.

FIGS. 4 and 5 respectively comprise the upper and lower portions of an exploded view of a corner joining arrangement including the panels 10 and 18 and the corner post 16 of the arrangement of FIG. 1. The panel 10 has a left hand edge 130 having a groove 132 therein for receiving a slotted spacing member 134. A bottom fastening member 136 mounted on the bottom edge 64 of the panel 10 via a pair of bolts 138 extends outwardly and upwardly within the groove 132 so as to engage the spacing member 134 within an aperture 140 at the bottom end 142 thereof. This serves to secure the lower portion of the spacing member 134 within the lower portion of the groove 132 within the edge 130 of the panel 10.

The center post 16 is provided with orthogonally disposed facing portions 144 and 146 which respectively include grooves 148 and 150 extending along the lengths thereof. The groove 148 within the facing portion 144 receives the spacing member 134 therein. The spacing member 134 is permanently secured within the groove 148 such as by screws 152. In similar fashion a slotted spacing member 154 is received within the groove 150 in the facing portion 146 and is secured therein by screws 152. The various screws 152 serve to hold the spacing members 134 and 154 securely within the grooves 148 and 150, respectively, of the center post 16.

The panel 18 has a facing portion 160 having a groove 162 therein. A bottom connecting member 164 which is secured to a bottom edge 166 of the panel 18 by screws 138 extends into the groove 162 at the bottom of the facing portion 160 where it curves upwardly for engagement within an aperture 168 at a bottom end 170 of the spacing member 154. With the spacing member 154 seated within the groove 162, the bottom connecting member 164 serves to hold the lower portion of the facing portion 160 of the panel 18 securely against the lower portion of the spacing member 154.

The upper portions of the facing portion 130 of the panel 10 and the facing portion 160 of the panel 18 are held securely against the upper portions of the spacing members 134 and 154, respectively, by a top connecting member 180 having a right angle bend 182 at an intermediate portion 184 thereof. The intermediate portion 184 of the top connecting member 180 is secured within a corresponding right angle groove 186 at the top of the corner post 16. One end portion 188 of the top securing member 180 extends over a top end 190 of the spacing member 134 and is fastened to the bottom surface of the groove 68 within the top edge 66 of the panel 10 by a pair of bolts 106 received within a pair of T-nuts 108. An opposite end portion 192 of the top connecting member 180 extends over a top end 194 of the spacing member 154 and is fastened to the bottom surface of a groove 196 within a top edge 198 of the panel 18.

As shown in FIG. 5 the base 62 of the panel 10 is made slightly longer than the panel 10 so as to extend under and serve as a base for the corner post 16. The panel 18 has a base 210 mounted on the bottom edge 166 thereof. The base 210 is equal in length to the panel 18 so as to terminate at the facing portion 160 and abut the end of the base 62 under the corner post 16.

As seen in FIG. 4 the top cap 70 of the panel 10 is longer than the length of the panel 10 so as to extend over and serve as a top cap for the corner post 16. The panel 18 has a top cap 212 mounted on the top edge 198 thereof. The top cap 212 is the same in length as the panel 18 so as to terminate at the facing portion 160 and abut the end of the top cap 70 extending over the corner post 16. The top caps 70 and 212 are removably mounted on the top edges of the respective panels by fastening arrangements which include the fastening brackets 72 and tapered or flared fastening elements with one such element 220 being shown at the underside of the top cap 212. As described in connection with FIG. 6 hereafter the element 220 engages an inclined slot in the top of a mating one of the fastening brackets 72 to hold the top cap 212 in place on the top edge 198 of the panel 18.

Each of the panels used in the arrangement of FIG. 1 is comprised of opposite faces which define the dimensions and edges for the panel and an intermediate core which is of slightly smaller dimension than the faces so as to form the grooves in the various panel edges. Referring to FIG. 4 the panel 10 is seen to comprise a pair of faces 230 and 232 disposed on opposite sides of an intermediate core 324. The core 234 is slightly smaller in size than the faces 230 and 232, thereby providing the groove 132 in the facing portion 130 and the groove 68 in the top edge 66.

FIG. 6 shows the upper left hand corner of the panel 10 with the face 230 removed. As seen in FIG. 6 the core 234 is essentially comprised of a hollow frame defining the bottom surfaces of the grooves at the various edges of the panel 10. A top frame member 236 extends along the top of the panel 10 between the faces 230 and 232 to define the bottom surface for the groove 68. A side frame member 238 extends along the edge of the panel 10 to define the surface within the groove 132 that engages the spacing member 134. A corner reinforcement 240 is fastened to the members 236 and 238 at their intersection. Prior to assembly of the members 236, 238 and 240 three different T-nuts 108 are installed through the bottom of the frame member 236 so that they extend to the top of the member 236. Two of the T-nuts 108 receive a pair of screws 106 to mount the end portion 188 of the top connecting member 180 as previously described. The third and innermost one of the T-nuts 108 is provided at each corner of each panel and is used to receive a bolt for mounting one of the bases.

As seen in FIG. 6 the fastening bracket 72 has opposite ends 250 and 252 thereof fastened to the bottom surface of the groove 68 and an inclined slotted intermediate portion 254 thereof extending between the end portions 250 and 252 and raised above the bottom surface of the groove 68. The slotted portion 254 forms a relatively small angle with the longitudinal axis of the panel. The flared fastener 220 secured to the underside of the top cap 70 has a portion 256 of reduced diameter which is disposed within the slot in the fastening bracket 72. As shown in FIG. 6 the fastening bracket 72 slopes upwardly toward the left. Although not shown other fastening brackets mounted on the top edge 66 of the panel 10 also slope upwardly to the left. Accordingly the top cap 70 is easily and readily installed upon completion of the joining arrangements by placing the fastening elements 220 within the slots of the respective brackets 72. The top cap 70 is then driven to the left as seen in FIG. 6 such as by tapping the right hand end thereof with a mallet so as to wedge the various fastening elements 220 within the brackets 72. Removal of the top cap 70 involves a simple reverse in the procedure. The top cap 70 is driven to the right as seen in FIG. 6 such as by striking the left end thereof with a mallet to loosen the fastening elements 220 within the brackets 72, following which the top cap 70 is simply lifted away from the top edge of the panel 10.

It will be seen that panel joining arrangements in accordance with the invention require panel edges of relatively simple configuration together with an intermediate spacing element which is of standard design and is a readily commercially available element. The bottom and top connecting members are of simple design and are easily fabricated from standard stock. It is not necessary to turn panels upside down or into various different positions to fasten them. Rather, joinder is effected simply by placing the spacing member over the bottom connecting member or members while disposing the spacing member within the grooves in the facing portions. Following that the top connecting member is screwed into place on the top edges of the panels, and the top caps are installed to hide the top connecting member and other hardware and provide the panels with a finished appearance. A mounting bracket 270 similar to the brackets 32, 34, 36 and 38 in the FIG. 1 arrangement is shown in detail in FIG. 7. The bracket 270 has a right angle bend along the length thereof between a first portion 272 and a second portion 274. The first portion 272 resides outside of the panel joint and is designed to be fastened to a shelf or similar member for support thereof. The second portion 274 extends through the small space between the adjacent panels on either side and engages the slotted spacing member to mount the bracket 270. When mounted the portion 274 has a relatively straight edge 276 which resides against the outside surface of the spacing member. A pair of hook members 278 and 280 extend outwardly from the edge 276 and terminate in finger portions 282 and 284, respectively, which extend downwardly and engage the inner surface of the hollow slotted spacing member. The finger portions 282 and 284 are spaced apart from the edge 276 by a distance approximately equal to the thickness of the spacing member between its inner and outer surfaces.

Disposed below the hook member 280 and extending outwardly from the edge 276 is a relatively small projection 286. The projection 286 extends outwardly from the surface 276 by a distance which is not substantially greater than the thickness of the spacing member between its inner and outer surfaces. The length of the projection 286 in the direction of the surface 276 is substantially less than the length of any of the slots in the spacing member.

The mounting bracket 270 is relatively easy to install and remove and yet functions to lock itself in place when mounted on the spacing member so as to avoid unnecessary or unwanted play and most importantly to prevent inadvertent upward movement or release of the mounting bracket. This results from the combined action of the hook members 278 and 280 and the projections 286 which also make the mounting bracket usable with slots of uniform size and uniform spacing.

As shown in FIG. 8 installation of the mounting bracket 270 is accomplished by inserting the second portion 274 thereof between the adjacent panels so that the hook members 278 and 280 extend into an adjacent pair of slots 290 and 292, respectively, while the projection 286 rests against the outside of the spacing member between the slot 292 and the next lower slot 294. This is also depicted in FIG. 9.

Because the distance between the surface 276 and the finger-like projections 282 and 284 is approximately equal to the thickness of the spacing member between its outer and inner surfaces, the surface 276 is urged against the outside surface of the spacing member as the mounting bracket 270 is moved downwardly so as to engage the finger-like projections 282 and 284 against the inside surface of the spacing member. However, contact of the surface 276 in the region of the hook member 280 and below is prevented by the projection 286 which rests against the outer surface of the spacing member as seen in FIG. 9. This causes the outer surface of the spacing member to press hard against the surface 276 in the region of the hook member 278 and the inside surface of the spacing member to press hard against the finger-like projection 284, with the result that the projection 286 is pressed against the outer surface of the spacing member with some force. For this reason a screwdriver 298 as shown in FIG. 8 or similar implement is conveniently used to force the mounting bracket 270 downwardly after the hook members 278 and 280 are inserted in the slots. The mounting bracket 270 is driven downwardly until the projection 286 enters the slot 294 and rests against the upper end of the slot 294. This action removes much of the wedging action and therefore the tension on the bracket 270 and the spacing member.

The projection 286 combines with the relatively snug fit of the finger-like projections 278 and 280 over the bottom portions of their respective slots 290 and 292 to hold the mounting bracket 270 securely on the spacing member and without unwanted play. At the same time the projection 286 prevents inadvertent upward movement or release of the bracket 270. However the projection 286 is not substantially longer than the thickness of the spacing member between the inner and outer surfaces. Consequently a sharp blow to the bottom of the mounting bracket 270 such as may be provided by the screwdriver 298 and a hammer drives the projection 286 out of the slot 294 and onto the outer surface of the spacing member between the slots 292 and 294. Continued upward force or tapping on the bracket 270 raises the bracket to the position shown in FIG. 9 at which point the bracket is pulled laterally outwardly to remove the hook members 278 and 280 from the slots.

While the invention has been particularly shown and described with reference to preferred embodiments thereof, it will be understood by those skilled in the art that the foregoing and other changes in form and details may be made therein without departing from the spirit and scope of the invention.

That which is claimed is:

1. An arrangement for joining first and second panel members at facing portions thereof, each of the facing portions having an upper portion adjacent the top of the panel member and a lower portion adjacent the bottom of the panel member, the arrangement comprising an elongated spacing member having an upper portion thereof terminating in a top end and a lower portion thereof terminating in a bottom end having an aperture therein, the spacing member being disposed between and in contact with the facing portions of the first and second panel members along the length thereof, a bottom connecting element mounted on the first panel member adjacent the bottom thereof, the bottom connecting element extending outwardly from the lower portion of the facing portion of the first panel member and curving upwardly and extending into and engaging the aperture in the bottom end of the spacing member to hold the lower portion of the facing portion of the first panel member against the lower portion of the spacing member, an elongated top connecting element having a first portion thereof fastened to the top of the first panel member, the top connecting element extending over the top end of the spacing member and having a second portion thereof opposite the first portion secured in place on the top of the second panel member, the top connecting element holding the upper portions of the facing portions of the first and second panel members against the upper portion of the spacing member, and means holding the lower portion of the facing portion of the second panel member against the lower portion of the spacing member.

2. The invention defined in claim 1, wherein the means holding the lower portion of the facing portion of the second panel member against the lower portion of the spacing member comprises a second bottom connecting element mounted on the second panel member adjacent the bottom thereof, the second bottom connecting element extending outwardly from the lower portion of the facing portion of the second panel member and curving upwardly and extending into and engaging the aperture in the bottom end of the spacing member, and the second portion of the top connecting element is fastened to the top of the second panel member.

3. The invention defined in claim 1, wherein the spacing member is fastened along the length thereof to the facing portion of the second panel member.

4. The invention defined in claim 1, wherein each of the panel members has a top cap releasably mounted on the top thereof by a plurality of fasteners, each having a slotted portion inclined at a small angle relative to the top of the panel member, and a plurality of elements each of which has a flared portion of varying size engaged in the slotted portion of a different one of the plurality of fasteners.

5. The invention defined in claim 1, wherein the spacing member holds the first and second panel members in spaced apart relation so as to form gaps of uniform size on opposite sides of the spacing member, and the spacing member has a hollow interior and a plurality of slots therein on opposite sides thereof adjacent the gaps, and at least one mounting bracket extending from outside the panel members through one of the gaps and into engagement with selected ones of the slots in the spacing member.

6. The invention defined in claim 4, wherein the slots in the spacing member are of uniform size and spacing and the mounting bracket has a pair of hook members extending into the different ones of an adjacent pair of the slots and having extending portions thereof engaging the inside surface of the spacing member, the extending portions of the hook members being spaced apart from portions of the mounting bracket in contact with the outside surface of the spacing member by distances which are not substantially different from the thickness of the spacing member between the outside and inside surfaces thereof, and a projection extending from the mounting bracket in the same general direction as the hook members, the projection being substantially smaller than the size of the slots and extending into a third slot in the spacing member different from said pair of slots by a distance which is not substantially greater than the thickness of the spacing member between the outside and inside surfaces thereof, the projection engaging the end of the third slot closest to said pair of slots.

7. A relatively thin, generally planar panel having at least one side edge thereof adapted to be joined to another panel, said side edge having a central slot therein for receiving a portion of an elongated spacing member, an elongated bottom connecting element mounted on a bottom edge of the panel adjacent said side edge thereof, said bottom connecting element extending along the bottom edge of the panel to said side edge and curving upwardly while extending into and terminating within said central slot to define a portion adapted to be received within a lower open end of the spacing member to hold the lower portion of the spacing member within the central slot, and means within a top edge of the panel adjacent said side edge for mounting one portion of an elongated top connecting element thereto, the top connecting element being adapted to be secured to another panel to hold the upper portion of the spacing member within the central slot.

8. A mounting arrangement comprising the combination of an elongated support member having a plurality of slots of uniform length uniformly spaced along the length thereof, each of the slots extending from an outer surface to an inner surface defining a hollow interior for the elongated support member, the elongated support member having a uniform thickness between the outer and inner surfaces, and at least one mounting bracket adapted to be mounted on the elongated support member and including a straight edge for disposition in contact with the outer surface of the elongated support member along the length of the straight edge when the mounting bracket is mounted on the elongated support member, a pair of hook members extending out from the straight edge at spaced apart locations along the length of the straight edge and having engaging portions at the outer portions thereof extending in a common direction along the straight edge and spaced apart from the straight edge by a distance substantially equal to the uniform thickness of the elongated support member between the outer and inner surfaces, said hook members being adapted to engage the lower edges of a pair of the slots when the mounting bracket is mounted on the elongated support member, and a projection extending out from the straight edge at a location spaced apart from the pair of hook members and in the common direction, the projection extending out from the straight edge by a distance which is not substantially greater than the uniform thickness of the elongated support member between the outer and inner surfaces, the projection having a maximum size along the length of the straight edge which is substantially less than the uniform length of the slots in the elongated support member and being adapted to wedge against the outer surface of the elongated support member as the hook members are inserted in a pair of the slots and moved toward the lower edges of the pair of slots, the projection snapping into and engaging the upper edge of one of the slots to lock the mounting bracket in position on the elongated support member as the hook members are moved into engagement with the lower edges of the pair of slots.

* * * * *